US009617023B2

(12) United States Patent
Zahn et al.

(10) Patent No.: US 9,617,023 B2
(45) Date of Patent: Apr. 11, 2017

(54) METHOD FOR PRODUCING CLUSTER PACKS

(71) Applicant: KHS GmbH, Dortmund (DE)

(72) Inventors: Volker Zahn, Volkmarsen (DE); Thomas Nitsch, Kleve (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/905,126

(22) PCT Filed: Jul. 3, 2014

(86) PCT No.: PCT/EP2014/064169

§ 371 (c)(1),
(2) Date: Jan. 14, 2016

(87) PCT Pub. No.: WO2015/007532

PCT Pub. Date: Jan. 22, 2015

(65) Prior Publication Data

US 2016/0159506 A1 Jun. 9, 2016

(30) Foreign Application Priority Data

Jul. 16, 2013 (DE) ..... 10 2013 107 574

(51) Int. Cl.
*B65B 17/02* (2006.01)
*B65B 27/04* (2006.01)
(Continued)

(52) U.S. Cl.
CPC ..... *B65B 17/02* (2013.01); *B65B 35/30* (2013.01); *B65D 21/0205* (2013.01);
(Continued)

(58) Field of Classification Search
CPC ..... B65B 13/20; B65B 17/02; B65B 21/06; B65B 27/04
See application file for complete search history.

(56) References Cited

U.S. PATENT DOCUMENTS 2,968,898 A * 1/1961 Hickin ..... B65B 21/06 53/157
3,759,373 A * 9/1973 Werth ..... B65D 21/0205 206/139

(Continued)

FOREIGN PATENT DOCUMENTS

DE 23 31 193 1/1975
DE 4126212 2/1993

(Continued)

*Primary Examiner* — Carson Gross
(74) *Attorney, Agent, or Firm* — Occhiuti & Rohlicek LLP

(57) ABSTRACT

A method for producing a cluster pack forming containers received in a container stream into lanes of single-track container streams, then for each lane, separating containers from neighboring containers by a pre-determined separation distance, for a subset of containers in the lane, applying adhesive to selected regions of the containers, rotating the containers in the subset such that adhesive regions of containers in the subset that are to be joined face each other, dividing off a pre-determined number of containers from the single-track container stream to form a container group. The method then includes pressing the container group against at least one other container group to form the cluster pack. The adhesive is selected such that a container is separable from the cluster pack by hand without damaging the container.

21 Claims, 6 Drawing Sheets

(51) Int. Cl.

| | |
|---|---|
| ***B65B 21/06*** | (2006.01) |
| ***B65D 21/02*** | (2006.01) |
| ***B65B 35/30*** | (2006.01) |
| *B65B 13/20* | (2006.01) |

(52) U.S. Cl.
CPC ..... *B65B 13/20* (2013.01); *B65B 21/06* (2013.01); *B65B 27/04* (2013.01)

(56) References Cited

U.S. PATENT DOCUMENTS

| | | | | |
|---|---|---|---|---|
| 7,726,464 | B2 | 6/2010 | Cerf | |
| 2004/0003575 | A1* | 1/2004 | Arends | B65B 21/04 53/398 |
| 2010/0308043 | A1* | 12/2010 | Wimmer | B65B 17/02 220/23.4 |

FOREIGN PATENT DOCUMENTS

| | | | | |
|---|---|---|---|---|
| DE | 10 2006 037 105 | | 2/2008 | |
| DE | 10 2007 039850 | | 2/2009 | |
| DE | 10 2009 025 824 | | 11/2010 | |
| DE | 102009025824 | A1 * | 11/2010 | B65B 17/02 |
| DE | 10 2009 044 271 | | 4/2011 | |
| DE | 10 2011 106759 | | 9/2012 | |
| DE | 10 2011 119966 | | 11/2012 | |
| DE | 10 2011 107264 | | 1/2013 | |
| DE | 10 2011 119967 | | 1/2013 | |
| EP | 2 096 039 | | 9/2009 | |

* cited by examiner

METHOD FOR PRODUCING CLUSTER PACKS

RELATED APPLICATIONS

This is the U.S. national stage of international application PCT/EP2014/064169, filed on Jul. 3, 2014, which claims the benefit of the Jul. 16, 2013 priority date of German application 102013107574.6, the contents of which are herein incorporated by reference.

FIELD OF INVENTION

The invention relates to packaging containers, and in particular, to packaging containers into groups of containers.

BACKGROUND

It is often useful to sell containers in groups, sometimes called "cluster packs."

A known way of forming cluster packs is by shrink-wrapping. This method has numerous disadvantages.

From the producer's point of view, shrink-wrapping is an expensive process because it requires considerable energy to heat the shrink-wrap so that it shrinks. Additionally, the shrink-wrap can obscure the labels. The resulting package can be somewhat unattractive.

From the consumer's point of view, shrink-wrap can be difficult to remove. Moreover, it is difficult to remove just one container from the package without undermining the integrity of the containers that remain. As a result, when one pulls a container out of the shrink-wrap, the remaining containers are apt to fall over.

Another alternative is strapping. This avoids the energy expenditure of shrink-wrapping. However, when strapping a rectangular array of bottles, the tension in the strap can sometimes cause a bottle to slip out of its location in the array and become nested at a location that is between the correct locations. This is similar to the manner in which inclusions find their way between lattice points in a crystal lattice.

From the consumer's point of view, strapping is undesirable because once a container is removed, the remaining containers are no longer held in a group. Thus, removal of a container disturbs the integrity of the original container cluster.

SUMMARY

It is an object of the invention to provide a simple method for producing cluster packs.

According to a first aspect of the invention, a cluster pack is produced by placing adhesive regions on surfaces of containers that are to form the cluster pack or a constituent container group of a cluster pack. These containers are then interconnected so that the adhesive regions bond to each other to produce a firm and stable cluster pack.

In another aspect, the invention includes assembling the containers that form the cluster pack or a constituent container group thereof by bonding with adhesive. Examples of adhesive include adhesive tape and self-adhesive strapping. The foregoing assembly procedure takes place after aligning the containers with respect to an orientation feature. An example of an orientation feature is a distinctive container feature or container-furnishing feature. As a result of the alignment, the containers in each cluster pack have a desired orientation. In particular, the containers are oriented with their container or furnishing features in a predetermined direction. This creates a cluster pack having a harmonious, visually appealing appearance that is far more attractive to a consumer than a cluster pack whose containers appear in disarray.

In the case of the present invention, aligning a container includes rotating the container about a container axis thereof. Optoelectronic sensors assist in recognizing alignment features. Based on these recognized features, it becomes possible to determine the correct angle of rotation. In some practices of the invention, container alignment occurs only after containers have already been combined into container groups that form the cluster pack. In that case, the optoelectronic sensors can no longer recognize alignment features from the side and therefore do so from above and/or from below.

A can typically has a can wall that tapers at the top of the can and/or at the can's shoulder. This tapered region is typically printed with the rest of the can wall. However, because its circumference is different from the rest of the can's wall, there is generally an overlap in the circumferential imprint. This overlap results in an optically distinctive orientation feature that can be used as a basis for orienting cans. Being a narrow line, the overlap region is optically easy to recognize. This makes it possible to accurately align the respective container in a desired orientation.

In one aspect, a method for producing a cluster pack includes receiving containers in a container stream, forming the containers into lanes of single-track container streams, then for each lane, causing each container to be separated from neighboring containers by a pre-determined separation distance, for a subset of containers in the lane, applying adhesive to selected regions of the containers, rotating the containers in the subset such that adhesive regions of containers in the subset that are to be joined face each other, dividing off a pre-determined number of containers from the single-track container stream to form a container group. The method then includes pressing the container group against at least one other container group to form the cluster pack. The adhesive is selected such that a container is separable from the cluster pack by hand without damaging the container.

In some practices, applying adhesive to selected regions of the containers includes applying adhesive to selected regions of at least two containers simultaneously.

Other practices include, after applying adhesive to selected regions of the containers, heating the adhesive. Among these are embodiments in which heating the adhesive includes exposing the adhesive to laser light.

In some practices, the method further includes, for each lane, for each container in the lane, orienting the container such that a furnishing feature on the container is oriented at a pre-defined orientation.

Yet other practices include strapping containers in the container group together with a strap.

In some practices, applying adhesive to selected regions of the containers includes applying adhesive to locations on a first vertical level of the containers and applying adhesive to locations on a second vertical level of only some of the containers. Among these practices are those in which applying adhesive to locations on a second vertical level includes leaving at least half of the corner containers, namely the containers at the corners of the cluster pack, free of adhesive on a lower level thereof. Also among these practices are those in which applying adhesive to selected regions of the containers includes applying adhesive to locations on a first vertical level of the containers and applying adhesive to locations on a second vertical level of the containers. Also among these practices are those that include selecting the adhesive to be a medium that, after curing, is brittle, and those that include selecting the adhesive to be a medium that, after separation of two containers from each other, remains on both containers.

Yet other practices include rotating a container about an axis thereof to cause an alignment feature on the container to have a predetermined orientation.

In some practices, pressing the container group against at least one other container group to form the cluster pack includes urging the container group in a direction towards a main transport path of the containers.

In other practices, rotating the containers includes rotating the containers independently of each other.

Also among the practices of the invention are those that include aligning the containers after dividing off a predetermined number of containers from the single-track container stream to form a container group, those that include bonding a carry handle to the cluster pack, and those that also include using an optoelectronic sensor in connection with recognizing an orientation feature on a container.

Alternative practices are those in which recognizing an orientation feature includes recognizing the orientation feature from either above or below the container and those that include using an overlap of a container imprint as an orientation feature.

A variety of adhesives can be used. In some practices, the adhesive is a flowable adhesive fluid. When this is the case, the adhesive can be applied by such methods as spraying, for example with a jet, and pressing, for example with a transfer element. An alternative adhesive is a hot-melt adhesive.

In another aspect, the invention features a cluster pack in which containers adhere to each other with adhesive. Each container has an adhesive region on an upper level thereof. But only some of the containers have an adhesive region on a lower level thereof.

In some embodiments, the cluster pack has corner containers. In these embodiments, at most half of the corner containers have adhesive on the lower level thereof.

Yet other embodiments include those in which the adhesive is one that, after having been cured, is brittle.

As used herein, the term "containers" refers to bottles, and cans, whether made of metal or plastic, and also soft packages, whether produced from card, plastic film, and/or metal foil.

As used herein, "orientation feature" means a primarily optically recognizable design feature of the respective container itself and/or of the container furnishing (container imprint and/or labeling) that has a unique position relative to a desired nominal orientation and on which the aligning to the desired orientation is effected, and/or the respective region of adhesive.

As used herein, "adhesives" refers to all materials or masses that facilitate or promote an adhesive bond between containers, in particular, compounds, materials, or masses that, when applied in liquid or semi-liquid state, form a self-adhesive region and/or bring about an adhesive bond under the application of pressure and/or energy and/or after curing or cross-linking, including through application of energy. As used herein, "adhesives" also includes multilayer materials, such as those comprising at least one carrier material that has been coated with a material with which an adhesive bond between containers is possible, are therefore adhesively active on at least two sides.

As used herein, "essentially," "in essence," and "around" refer to variations from a respective exact values by ±10%, preferably by ±5% and/or variations in the form of changes insignificant for the function.

Further embodiments, advantages, and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description. It has been shown to be particularly advantageous when at least some of the regions of adhesive are applied in such a way that regions of adhesive are always applied to both of the opposite surface regions which are to be joined together by a region of adhesive.

Particularly when hot-melt adhesives are used, it is an advantage for the regions of adhesive to be applied simultaneously to the respective surface regions of the containers to be bonded. This simultaneous application offers advantages when there are significant temperature differences between the filled bottle and the temperature of the adhesive region.

Some practices also include providing at least one heating medium by which the adhesives are heated up before being finally brought together and/or compressed. An infrared or laser emitter in particular can be provided for this purpose, in particular a motorized travelling laser emitter or infrared emitter.

Non-limiting embodiments of the present invention will now be described by way of reference to the accompanying figures in which:

DETAILED DESCRIPTION

Figure 1:
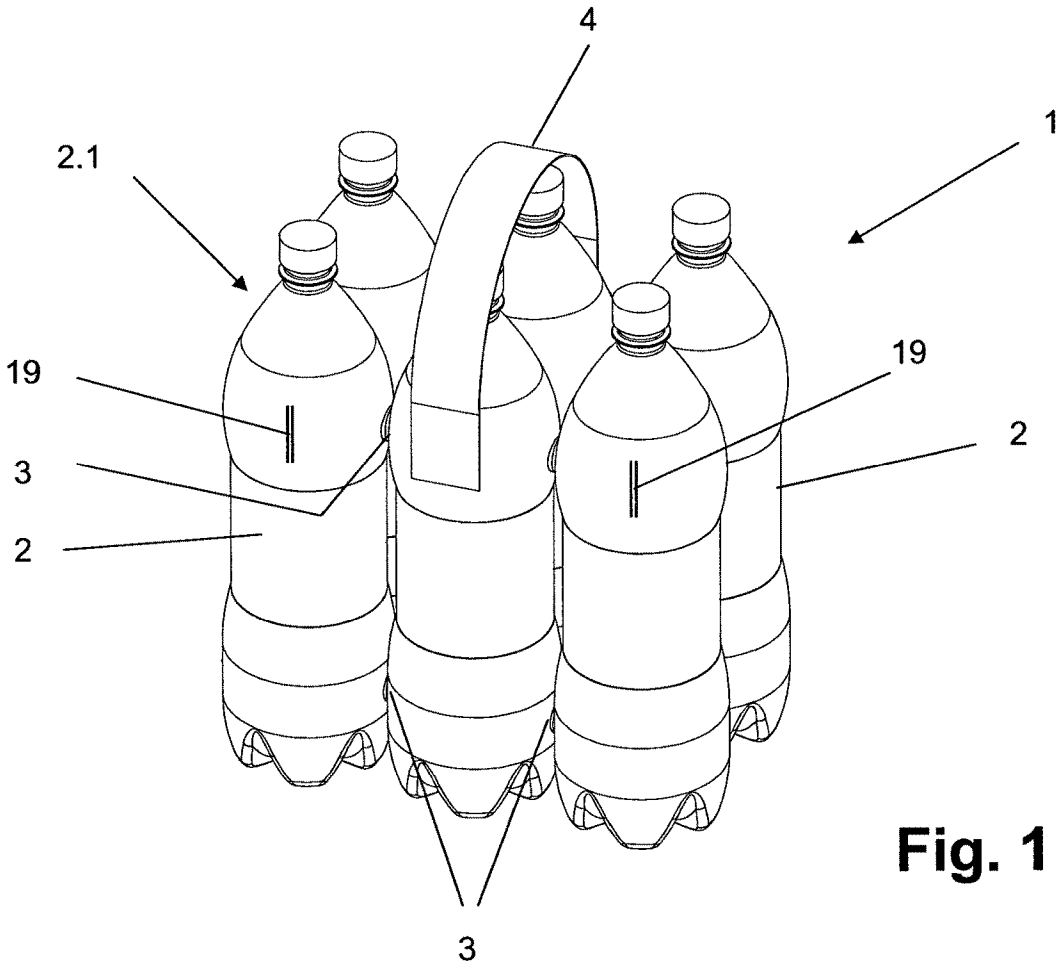
FIG. 1 shows six bottles bonded to form a cluster pack.

FIG. 1 shows a cluster pack 1 having six containers 2 connected directly to one another with adhesive regions 3. In the illustrated embodiments, the containers 2 happen to be bottles. The cluster pack 1 has a first outer-group 2.1, a second outer group 2.2, and a middle group 2.3 between the first and second outer groups 2.1, 2.2.

Figure 2:
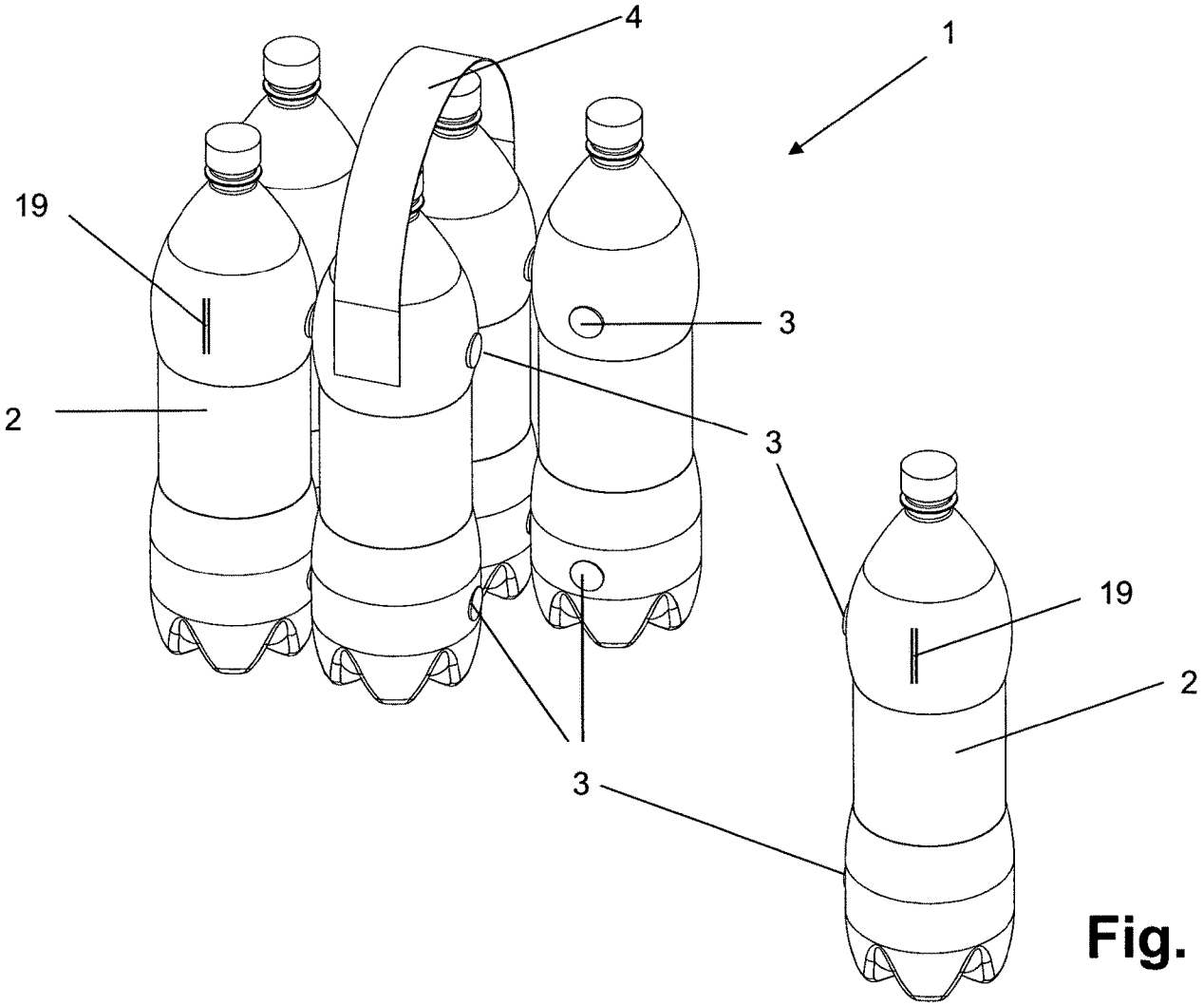
FIG. 2 shows the cluster pack of FIG. 1 from which a container has been removed.

Each container 2 in a cluster pack 1 has a surface upon which adhesive regions 3 have been applied at different locations. An example is shown in FIG. 2, in which the cluster pack 1 of FIG. 1 has had a corner bottle removed so that the adhesive regions 3 can more clearly be seen. In the embodiment shown in FIG. 2, the adhesive region 3 consists of a pair of adhesive spots separated along the bottle's axis. However, other adhesive regions 3 can be implemented. For example, in one embodiment, the lower adhesive spot is missing and the adhesive region only has the upper adhesive spot. This can make it easier to remove the bottle from the cluster 1.

In some embodiments, a cluster pack 1 also has a carrying handle 4 consisting of a suitable ribbon-shaped flat material. Additional adhesive attaches the handle 4 to the cluster pack 1. In the illustrated embodiment, the handle 4 attaches to the containers in the middle group 2.3.

Figure 3:
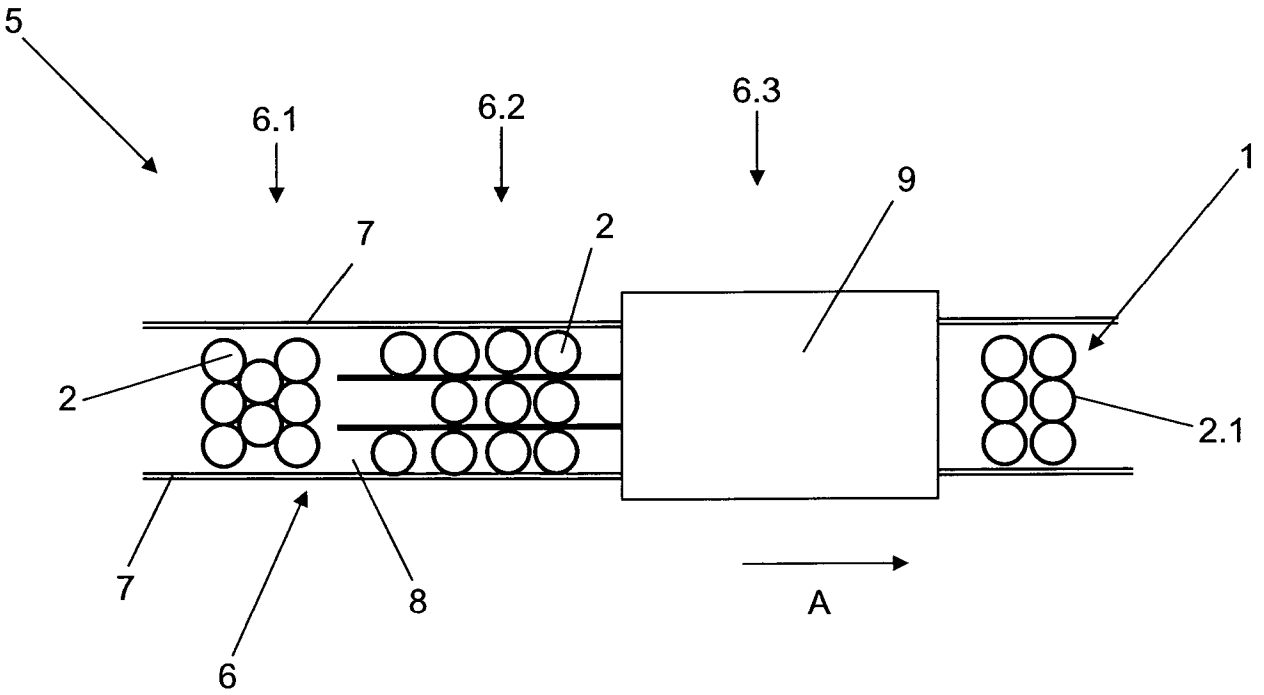
FIG. 3 shows a cluster-packer for making cluster packs as shown in FIG. 1.

FIG. 3 shows a cluster-packer 5 for producing cluster packs 1. The cluster-packer 5 includes a transporter 6 on which containers 2 stand with their container axes oriented vertically or essentially vertically. The transporter 6 includes a first transport section 6.1, a second transport-section 6.2 that immediately follows the first transport-section 6.1 in a transport direction A, and a third transport-section 6.3 that immediately follows the second transport-section 6.2 in a transport direction A The transporter 6 conveys containers along the transport direction A through the first, second, and third transport-sections 6.1, 6.2, 6.3.

In the first transport-section 6.1, the containers are transported in bulk. This means that the containers 2 are randomly distributed on the conveyor.

In the second transport-section 6.2, guide rails 6 organize the disordered containers 2 into lanes 8A-8C, each of which defines a single-track container stream. In the illustrated embodiment, there are three such lanes: a first outer lane 8A, a second outer lane 8B, and a middle lane 8C. The first and second outer lanes 8A, 8B will form the first and second outer groups 2.1, 2.2. The middle lane 8C will form the middle group 2.3.

In the third transport-section 6.3, the containers pass through a workstation 9. It is here that the adhesive regions 3 are applied to the containers 2, that the containers are pressed together to form container groups 2.1, 2.2, 2.3, and that the container groups 2.1, 2.2, 2.3 are pressed together to form a cluster pack 1. For those cluster packs 1 that have handles 4, the workstation 9 also attaches the handle 4.

Figure 4:
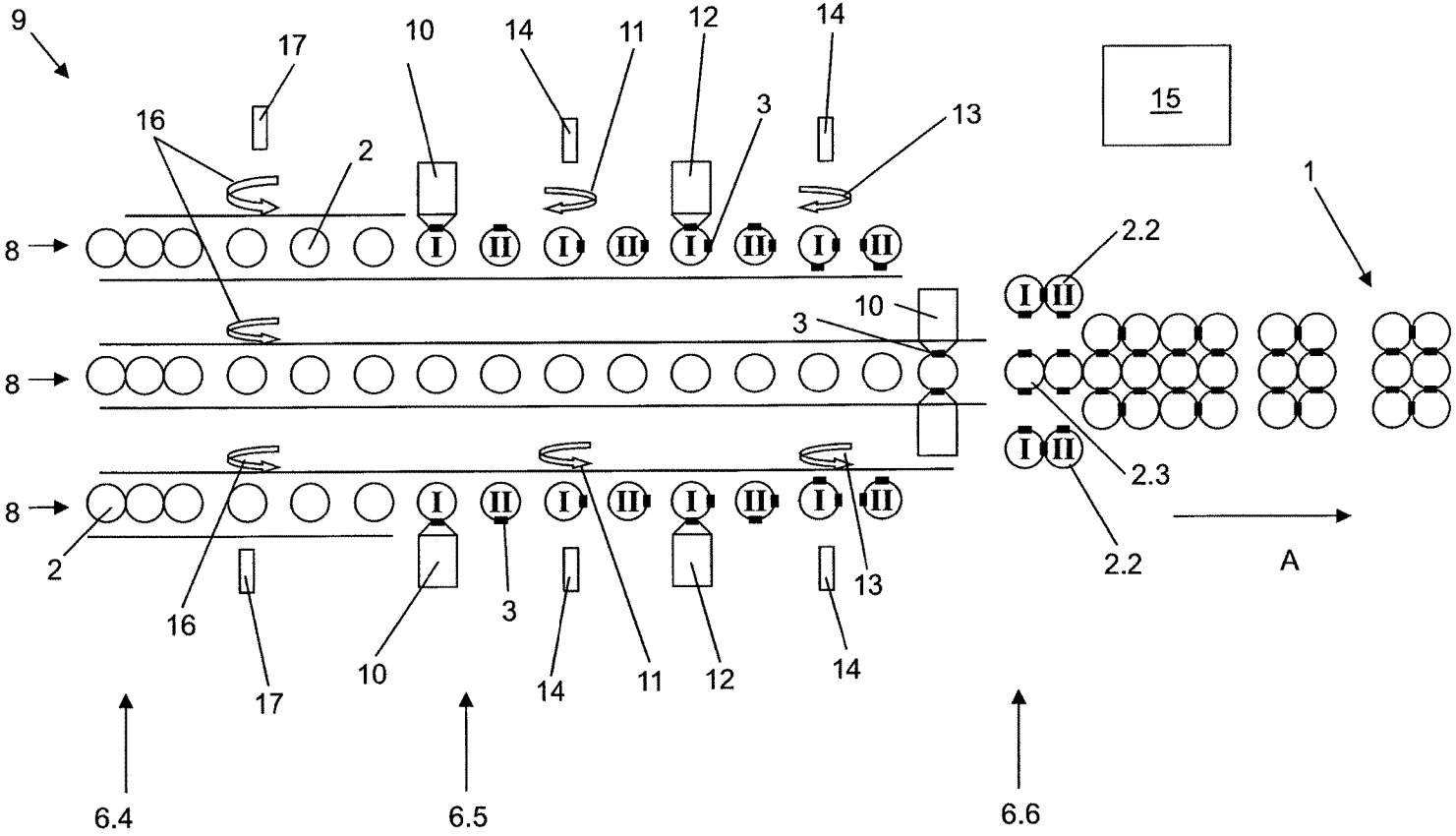
FIG. 4 shows the details of the work station shown in FIG. 3.

Within the workstation 9, the third transport-section 6.3 is divided into a separating section 6.4, a gluing section 6.5, and a pressing section 6.6, as shown in FIG. 4. These follow each other in the transport direction A so that that the gluing section 6.5 is immediately downstream of the separating section 6.4 and the pressing section 6.6 is immediately downstream of the gluing section 6.5.

Within the separating section 6.4, containers are separated from each other in both dimensions. Containers in one lane are separated from containers in other lanes and containers within a lane are separated from neighboring containers in that lane.

The various lanes 8A-8C process containers somewhat differently. In order to efficiently discuss the manner in which each lane 8A-8C processes containers, it is useful to now define a polar coordinate system centered on a container's axis. The zero degree angle is defined as facing the transport direction A. A positive direction of rotation is defined as clockwise.

As a first container I proceeds down the gluing section 6.5 on the second outer-lane 8B, it passes by a first applicator 10. The first applicator 10 applies a first adhesive region 3 at 90 degrees on the first container's side as the first container I passes by.

After having received a first adhesive region 3, the first container I proceeds to a first turning device 11. The first turning device 11 rotates the first container I so that the first adhesive region 3 now faces the transport direction A at zero degrees.

The first container I then passes by a second applicator 12. The second applicator 10 applies a second adhesive region 3 at 90 degrees on the first container's side as the container 2 passes by. In some embodiments, the first and second applicators 10, 12 apply adhesive regions 3 in pairs with one being an upper region and other being a lower region. A second turning device 13 that follows the second applicator 12 then rotates the first container I so that the one adhesive region 3 now faces the transport direction A and another adhesive region faces 270 degrees.

The second outer-lane 8B processes a second container II between two first containers I in the same way until the second container II reaches the second turning device 13. In the case of a second container II, the second turning device 13 rotates the container so that one adhesive region faces 270 degrees and the other faces 180 degrees. As a result, the adhesive region 3 facing zero degrees on the first container I is in position to later engage the adhesive region facing 180 degrees to form the second outer-group 2.2 of the cluster pack 1.

The middle lane 8C processes containers somewhat differently. It ultimately yields a middle row 2.3 in which each container has an adhesive region 3 at 90 degrees and at 270 degrees. The adhesive regions 3 at 90 degrees will ultimately engage the adhesive regions 3 at 270 degrees in the second outer-row 2.2. The adhesive regions 3 at 270 degrees will ultimately engage corresponding adhesive regions 3 at 90 degrees in the first outer-row 2.1. In the embodiment shown, the containers in the middle row 2.3 are not joined to each other by adhesive regions 3 at 0 degrees and 180 degrees. However, the illustrated center lane 8C can easily be modified to add such adhesive regions 3 as already described in connection with the first and second outer-lanes 8A, 8B.

The first outer-lane 8A processes first and second containers I, II in a similar manner with the exception that the turning devices in the first outer-lane 8A ultimately result in a first outer-group 2.1 in which each container has an adhesive region 3 facing 90 degrees to engage corresponding adhesive regions 3 facing 270 degrees from the middle group 2.3.

Finally, the pressing section 6.6 receives loose containers that have been prepared with adhesive regions in all the correct locations to form the cluster pack 1. It then presses pairs of containers from the first outer-lane 8A so that the regions facing 0 degrees and 180 degrees connect to each other. This forms the first outer-group 2.1. Similarly the pressing section 6.6 presses pairs of containers from the second outer-lane 8B so that the regions facing 0 degrees and 180 degrees connect to each other. This forms the second outer-group 2.2. Then, the pressing section 6.6 presses the first and second outer-groups 2.1, 2.2 toward the middle group 2.3 so that regions facing 90 degrees on the first outer-group 2.1 engage regions facing 270 degrees in the middle group 2.3 and so that regions facing 270 degrees in the second outer-group 2.2 face regions facing 90 degrees in the middle group 2.3.

The resulting cluster pack 1 continues in the transport direction A to another plant component such as a palletizer.

The rotating and aligning of containers 2 at the first and second turning devices 11, 13 is preferably controlled by corresponding first and second sensors 14A, 14B that send corresponding first and second sensor signals to a processor 15. A suitable sensor 14A, 14B is an optoelectronic sensor, such as a camera.

The processor 15 analyzes the first and second sensor signals and generates suitable control signals to control the first and second turning devices 11, 13. To operate correctly, the processor 15 relies in part on alignment features extracted from the first and second sensor signals. A suitable alignment feature that can be used as a basis for controlling the turning devices 11, 13 is an adhesive region 3.

In some embodiments, the processor receives a third sensor signal from a corresponding third sensor 17 in the separating section 6.4 and uses that as a basis for controlling a third turning device 16 in the separating section 6.4. Based on the third sensor signal, the processor 15 identifies a container-furnishing feature 19 and sends a control signal to the third turning device 16. The third turning device 16 then turns the container to an extent selected to ultimately create a visually appealing appearance for the cluster pack 1 that is consistent and repeatable.

Distinctive features 19 of containers 2 that can be relied upon as a basis for controlling the third turning device 16 include an overlap region of an imprint.

By appropriate adaptation of the first and second applicators 10, 12 it is possible to apply adhesive regions 3 in different ways. For example, in some embodiments, the adhesive is a fluid that, after having been applied, is suitably dried and/or cured to create adhesive regions 3 that are self-adhesive and/or that, under pressure, generate an adhesive bond.

The flowable adhesive, such as a liquid or semi-liquid, adhesive fluid, is applied to the container's surface by, for example, being sprayed or pressed on, for example using moving transfer pads.

A hot-melt adhesive is also a suitable choice for an adhesive region 3. Such an adhesive can be applied in a hot liquid or semi-liquid state through jets. The containers are then pressed together while the hot-melt adhesive is still liquid.

Additional adhesives that are suitable are those that are curable upon application of energy. Examples are adhesives that are cured by being heated or by being irradiated with electromagnetic radiation, including infrared radiation, UV radiation, X-rays, or microwaves, as well as adhesives that are cured upon exposure to nuclear radiation and/or electron radiation. These adhesives may in turn be part of adhesive tapes or contact adhesive compounds that consist of the strip-like substrate material.

Suitable adhesives are those made of substances that provide good adhesion to the material from which the containers are made as well as high cohesion, which refers to the internal strength in a layer of adhesive. These properties promote formation of a stable cluster pack.

In other embodiments, the containers are pressed together and energy is added to melt the adhesive, after which the containers are allowed to cool to solidify the adhesive again. The added energy can be heat or infrared radiation.

An adhesive region 3 can also be created by an adhesive body or adhesive film. Examples include adhesive tapes or adhesive labels and, in particular, double-sided adhesive tapes or double-sided adhesive labels. A suitable type of adhesive tape is that offered by tesa SE, 20253 Hamburg under the trade name "Powerstrip."

The foregoing techniques can also be used to attach the carrying loop or carrying handle 4 to two containers 2.

Figure 5:
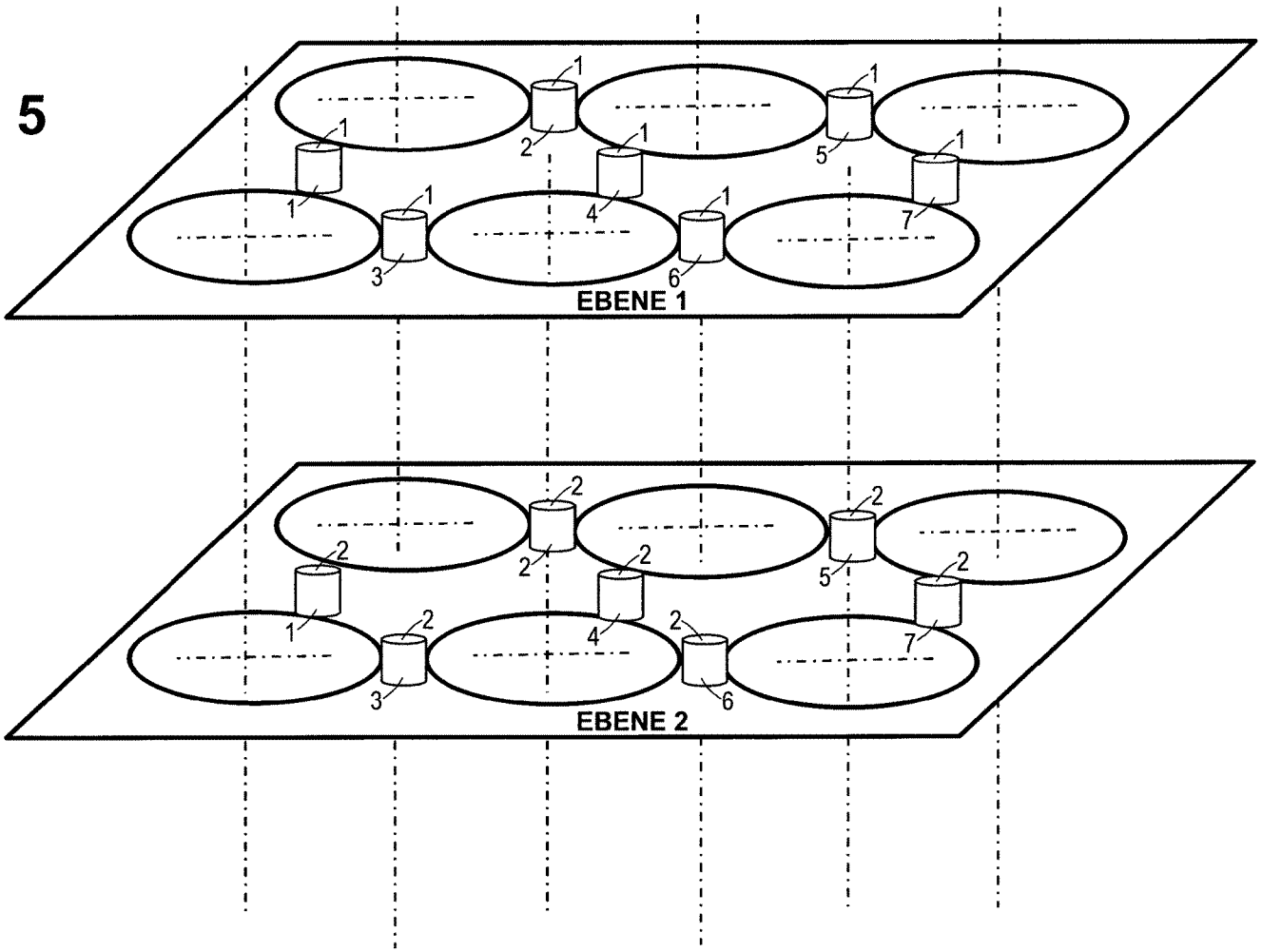
FIG. 5 shows a cluster pack in which all containers are fully bonded to one another.

As shown in FIG. 2, the cluster pack 1 of FIG. 1 has an adhesive region that consists of a first spot and a second spot below the first spot. Referring to FIG. 5, there are thus seven first adhesive spots S11, S12, S13, S14, S15, S16, S17 distributed in a first plane 20 and seven second adhesive spots S21, S22, S23, S24, S25, S26, S27 distributed in a second plane 30. The rest of the bottles have been omitted from FIG. 5 so that the adhesive spots can be seen clearly. The six circles shown in the first plane 20 define the intersections of the six bottles with the first plane 20. Similarly, the six circles shown in the second plane 30 define the intersections of the six bottles with the second plane 30. The second plane 30 is closer to the container's base than the first plane 20.

In the pattern shown in FIG. 5, if the adhesive is hard, brittle, or has high bonding power, it may be difficult to manually remove the first bottle from the pack.

Figure 6:
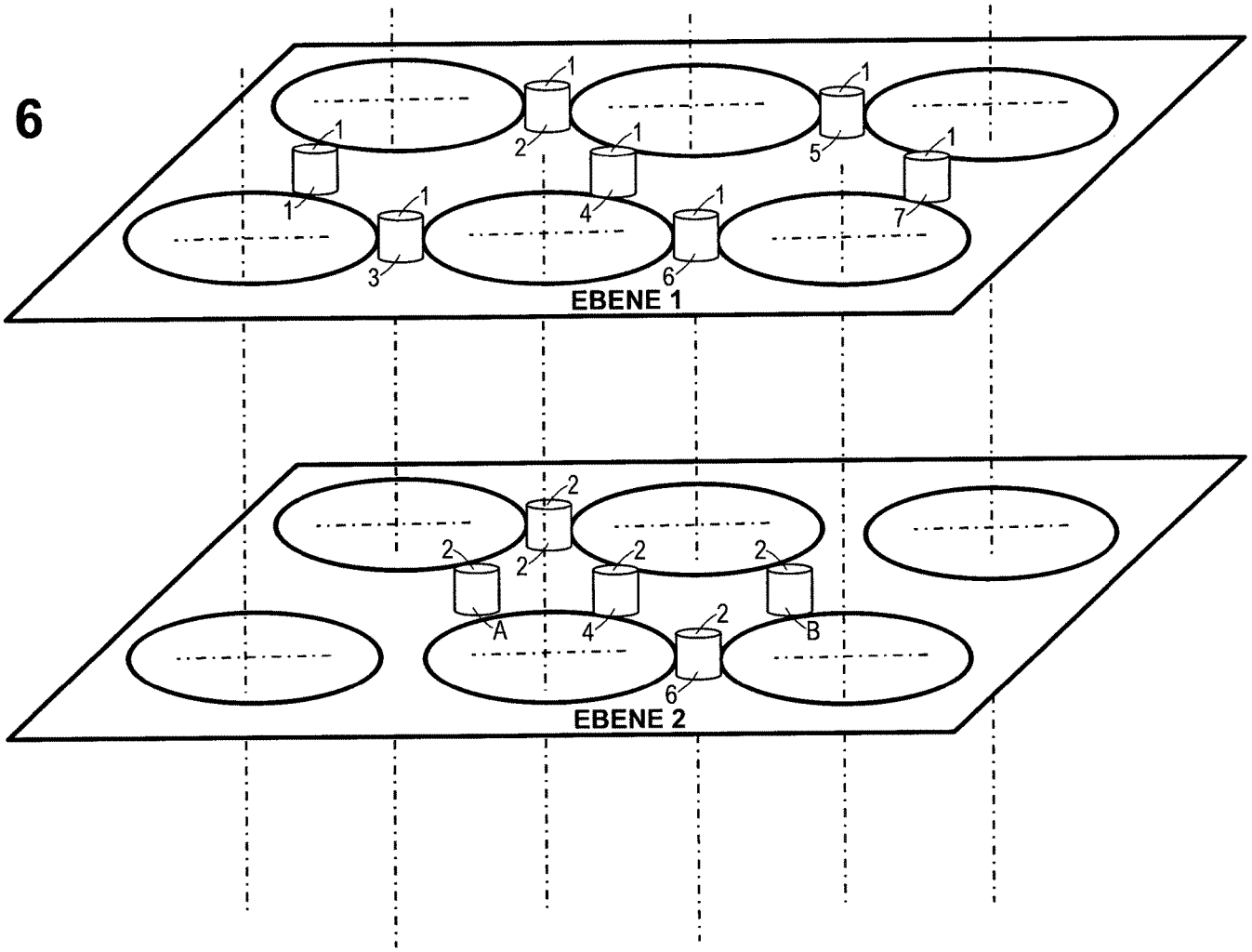
FIG. 6 shows a cluster pack having free-hanging corner containers.

In an effort to promote easier removal of the first bottle, an alternative configuration of adhesive spots shown in FIG. 6 omits the adhesive spots for two corner bottles in the lower plane 30. However, two adhesive spots S28, S29 have also been added to the lower plane 30 to stabilize the cluster pack 1.

Surprisingly, it has been shown that the adhesive point configuration shown in FIG. 6 is ideal for the one-handed removal of the corner bottles from the pack by a person of average strength while still maintaining a cluster pack 1 that is compact and strong enough for easy transport and handling.

With the cluster pack 1 of FIG. 6, two of the corner bottles hang free at the bottom. Each corner bottle thus forms a lever with the remaining adhesive spot as a fulcrum. As such, the corner bottles can easily be detached by tilting them upward. The mechanical advantage offered by this lever means that even a strong adhesive can be used without impairing the ease with which a corner bottle can be detached.

The two adhesive points S28, S29 are optional and can also be omitted. In this embodiment, only three adhesive points S22, S24, S26 are provided on the lower plane 30.

In some embodiments, appropriate strapping binds an aligned container group. Suitable strapping includes tape, such as transparent tape, self-adhesive tape, tape with self-adhesive regions, tape that is provided with adhesive fluid before being applied to a container group 2.1, 2.2, 2.3 of aligned containers 2, and/or tape having ends that can be thermally welded to create strapping that wraps around a container group 2.1, 2.2, 2.3 and holds it together.

In some methods of cluster pack manufacture, both adhesive and strapping are used. In particular, this is carried out in such a way that the strapping only affects a certain container group 2.1, 2.2, 2.3.

In some methods of cluster-pack manufacture, it is useful to apply a coating fluid to those regions that are to be connected with either strapping or adhesive. A suitable coating fluid is a primer that improves the adhesion of strapping or adhesive material on the region on which it is placed. Other examples of a suitable coating fluid are those with a silicate or acrylic base, and, if required, with photo inhibitors. Such coating fluids can be cured rapidly with UV radiation.

On the other hand, depending on the adhesive or the substrate, it may also be useful to provide a coating fluid that promotes undamaged detachment or separation of the containers by the consumer. Such coating fluids are those that reduce or completely prevents sticking or adhesion. Examples of suitable coating fluids of this type are those that are based on silicones, silicone oils or fats. With these coating fluids, it is often not important that they harden or cure particularly rapidly. The important requirement in this case is that such coating fluids not cause contamination.

Some embodiments compensate for the slightly convex container wall by providing adhesive regions that are somewhat raised. This increases contact area on the normally slightly convex container wall. Ideally the method is used for the simultaneous or essentially simultaneous application of adhesives in combination, but this is not absolutely essential and will depend on the adhesive. Especially with strongly bonding and brittle adhesives with which the curing or setting of the exposed surface of the adhesive must first be activated, e.g. by way of a UV emitter, the adhesive application pattern according to FIG. 5 or 6 is also quite independently advantageous.

The invention has been described by reference to particular embodiments. It goes without saying that variations as well as modifications are possible without departing from the inventive concept underlying the invention.

Having described the invention, and a preferred embodiment thereof, what is claimed as new, and secured by Letters Patent is:

1. A method for producing a cluster pack, said method comprising receiving containers in a disordered container stream, forming said containers into lanes of single-track container streams, for each lane, causing each container in said lane to be separated from neighboring containers in said line by a pre-determined separation distance, for each lane, for a subset of containers in said lane, applying adhesive to selected regions of said containers, rotating said containers in said subset such that adhesive regions of containers in said subset face each other, as a result of which said adhesive regions that face each other are ready to be joined upon being brought into contact with each other, for each lane, dividing off a pre-determined number of containers from said single-track container stream to form a container group, and pressing said container group against at least one other container group to at least partially form said cluster pack, wherein said adhesive that joins containers to each other is selected such that a container is separable from a container to which it is joined by said adhesive by hand without damaging said container, wherein applying adhesive to selected regions of said containers comprises applying adhesive to locations on a first vertical level of said containers and applying adhesive to locations on a second vertical level of only some of said containers.

2. The method of claim 1, wherein applying adhesive to selected regions of said containers comprises applying adhesive to selected regions of at least two containers simultaneously.

3. The method of claim 1, further comprising, after having applied adhesive to selected regions of said containers, heating said adhesive.

4. The method of claim 3, wherein heating said adhesive comprises exposing said adhesive to laser light.

5. The method of claim 1, wherein each of said containers has a randomly oriented furnishing feature, wherein said method further comprises, for each lane, for each container in said lane, orienting said container such that said furnishing feature is oriented at a pre-defined orientation.

6. The method of claim 1, further comprising strapping containers in said container group together with a strap.

7. The method of claim 1, wherein said containers comprise corner containers that are to be located at corners of said cluster pack, wherein applying adhesive to locations on a second vertical level comprises leaving at least half of said corner containers free of adhesive on a lower level thereof.

8. The method of claim 1, further comprising selecting said adhesive to be a medium that, after curing, is brittle.

9. The method of claim 1, further comprising selecting said adhesive to be a medium that, after separation remains on both containers.

10. The method of claim 1, wherein each of said containers has a randomly-oriented alignment feature, wherein said method further comprises rotating a container about an axis thereof to cause said alignment feature to have a predetermined orientation.

11. The method of claim 1, wherein pressing said container group against at least one other container group to form said cluster pack comprises urging said container group in a direction towards a main transport path of said containers.

12. The method of claim 1, wherein rotating said containers comprises rotating said containers independently of each other.

13. The method of claim 1, further comprising aligning said containers after having divided off a pre-determined number of containers from said single-track container stream to form a container group.

14. The method of claim 1, further comprising bonding a carry handle to said cluster pack.

15. The method of claim 1, further comprising using an optoelectronic sensor and a processor associated therewith to recognize an orientation feature on a container.

16. The method of claim 15, wherein recognizing an orientation feature comprises recognizing said orientation feature from a direction selected from the group consisting of above said container and below said container.

17. The method of claim 1, wherein each of said containers has a furnishing feature, and wherein said furnishing feature comprises an overlap of a container imprint, said method further comprising using said overlap as an orientation feature.

18. The method of claim 1, further comprising selecting said adhesive to be a flowable adhesive fluid.

19. The method of claim 18, further comprising applying said adhesive fluid to said containers by spraying.

20. The method of claim 18, further comprising applying said adhesive fluid to said containers by pressing.

21. The method of claim 1, further comprising selecting said adhesive to be a hot-melt adhesive.

* * * * *